US005572972A

United States Patent [19]

Sheridan et al.

[11] Patent Number: 5,572,972

[45] Date of Patent: Nov. 12, 1996

[54] MECHANICAL AIR-FUEL CONTROL FOR FEEDBACK CONTROL OF EXTERNAL DEVICES

[75] Inventors: Todd A. Sheridan, Franklin; Rod Radovanovic; Angela R. May, both of Columbus, all of Ind.

[73] Assignee: Cummins Engine Company, Inc., Columbus, Ind.

[21] Appl. No.: 257,874

[22] Filed: Jun. 10, 1994

[51] Int. Cl.[6] ..... F02D 31/00

[52] U.S. Cl. ..... 123/357; 123/373

[58] Field of Search ..... 123/357, 569, 123/571, 383, 373

[56] References Cited

U.S. PATENT DOCUMENTS

| | | | |
|---|---|---|---|
| 4,137,517 | 1/1979 | Garcea | 123/357 |
| 4,388,909 | 6/1983 | Ogasawara et al. | 123/569 |
| 4,426,969 | 1/1984 | Eheim | 123/357 |
| 4,495,929 | 1/1985 | Maeda | 123/569 |
| 4,524,740 | 6/1985 | Brockhaus | 123/357 |
| 4,569,319 | 2/1986 | Thoma | 123/357 |
| 4,616,615 | 10/1986 | Kawaguchi et al. | 123/357 |
| 4,738,110 | 4/1988 | Tateno . | |
| 4,903,488 | 2/1990 | Shibata . | |
| 5,133,188 | 7/1992 | Okada . | |
| 5,188,076 | 2/1993 | Alverez-Avila | 123/373 |

*Primary Examiner*—Carl S. Miller

*Attorney, Agent, or Firm*—Woodard, Emhardt, Naughton, Moriarty & McNett

[57] ABSTRACT

A control system for a diesel engine for creating an ON/OFF feedback signal for controlling engine-related functions includes a mechanical assembly involving a fuel injection pump, a governor for the fuel injection pump, a pair of cam stops as part of the governor and an electrically grounded moveable rack finger. One of the cam stops is a fixed stop which limits travel of the rack finger and thus limits fueling to a predetermined level. The only variable which determines fuel quantity for this full load cam stop is engine speed. The second stop which limits rack finger travel is an air-fuel cam stop which has two independent variables that determine the fuel limit. These independent variables are engine speed and engine boost pressure. The air-fuel cam stop is placed within a housing which is electrically isolated from the rest of the fuel pump and the engine. Once there is contact between the moveable rack finger and the air-fuel cain an electrical signal (ON) is created which may be used to activate or energize other engine-related functions such as shutting off EGR during air limited operation.

14 Claims, 9 Drawing Sheets

MECHANICAL AIR-FUEL CONTROL FOR FEEDBACK CONTROL OF EXTERNAL DEVICES

BACKGROUND OF THE INVENTION

The present invention relates generally to feedback control systems and devices wherein a signal is created in response to certain conditions and criteria and used to control or influence external devices or systems. More specifically the present invention relates to the use of a mechanical air-fuel control to form an electrical switch to control external devices, such as an exhaust gas recirculation (EGR) system.

The present inventors are aware of various studies which have been conducted regarding EGR and its desirability during various engine operating conditions. Preliminary results of such EGR studies being conducted on the B Series diesel engines of Cummins Engine Company, Inc. of Columbus, Ind. indicate that it would be desirable to shut off EGR during air limited operation. During air limited operation (acceleration modes in Federal Transient Emissions cycle) EGR increases particulate emissions more than in any other engine operating mode. The present invention provides a mechanical air-fuel control which can be used to provide an ON/OFF signal which corresponds directly to air limited/non-air limited engine operation.

Use of the present invention is not limited to EGR and air limited operation. In a hybrid boosting system where both a turbocharger and a mechanically driven supercharger are present, the same ON/OFF signal created by the mechanical air-fuel control can be used to engage or disengage the mechanically driven supercharger. The value of this application for the present invention is to provide extra boost above that provided by the turbocharger, but only when extra boost is needed. In this way, by only engaging the supercharger when it is needed for extra boost, the fuel consumption penalty caused by use of a supercharger is reduced, and hopefully minimized.

The present inventors are aware of certain diesel engine arrangements which are equipped with both an exhaust driven turbocharger and a mechanically driven supercharger. What is believed to be a representative sampling of such diesel engine arrangements is provided by the follow patent references:

| Patent No. | Patentee | Issue Date |
|---|---|---|
| 4,738,110 | Tateno | Apr. 19, 1988 |
| 4,903,488 | Shibata | Feb. 27, 1990 |
| 5,133,188 | Okada | Jul. 28, 1992 |

Each of these listed patent references discloses a control system for controlling the flow of intake air and exhaust gas through the engine by both controlling the flow valves and by engaging/disengaging the mechanically driven supercharger in response to the position of an accelerator pedal or throttle. However, in each of these systems, an electrical system is used to detect the degree of depression of the accelerator pedal or throttle and to produce a corresponding output voltage. Therefore, none of these references disclose the specifics of the present invention which involves the use of a mechanical governor to create an electrical signal upon contact between a rack finger and a fuel limiting stop in order to control an EGR valve or the operation of a supercharger. Also, none of these listed patent references recognize the concept of electrically isolating a fuel limiting stop from the remainder of the engine in such a manner so as to provide contact between the moveable rack finger and the fuel limiting stop only during certain operating conditions of the engine, such as air limited operation.

SUMMARY OF THE INVENTION

A control system for a diesel engine for creating an ON/OFF feedback signal for controlling engine-related functions according to one embodiment of the present invention comprises a fuel injection pump, a fuel pump governor having a full load cam stop and an air-fuel cam stop, an air-fuel cam housing mounted to the fuel injection pump and receiving the air-fuel cain stop, electrical isolation means for electrically isolating the housing from the fuel injection pump and an electrically grounded rack finger which is moveable toward the air-fuel cam stop in response to engine speed, wherein contact of the air-fuel cam stop by the rack finger creates an electrical ON signal, the ON signal being electrically suitable to control the engine-related functions.

One object of the present invention is to provide an improved mechanical air-fuel control for feedback control of external devices in a diesel engine.

Related objects and advantages of the present invention will be apparent from the following description.

DESCRIPTION OF THE PREFERRED EMBODIMENT

Figure 1:
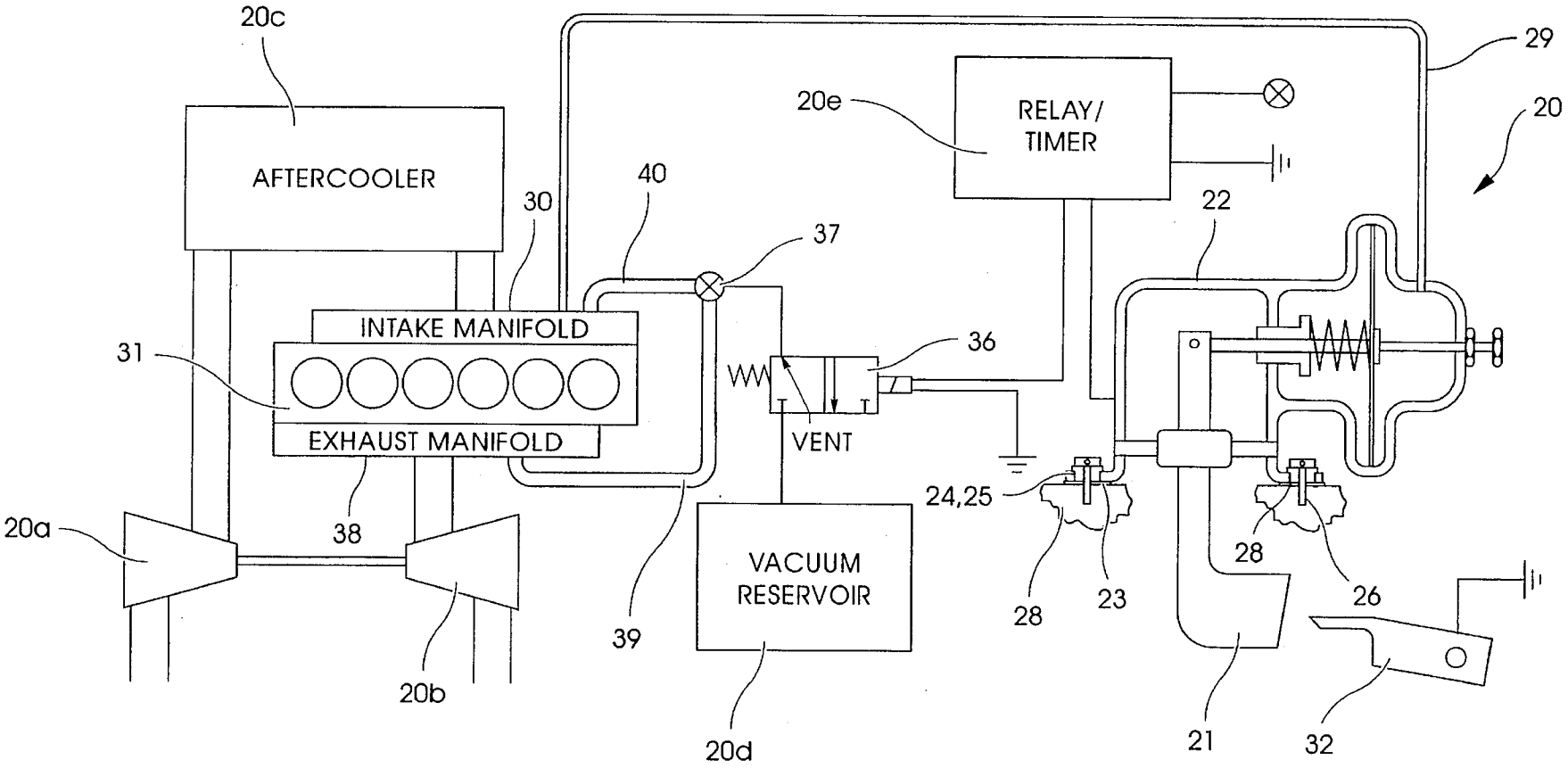
FIG. 1 is a schematic flow chart of a diesel engine assembly including portions of a fuel pump governor and means to create a mechanical air-fuel control for feedback control of external devices according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is schematically illustrated a control system 20 according to the present invention. Control system 20 is incorporated as part of a diesel engine which includes a compressor 20*a*, turbine 20*b*, aftercooler 20*c*, vacuum reservoir 20*d* and relay/timer 20*e*. Control system 20 includes an air-fuel cam 21, a portion of which is disposed within an electrically isolated housing 22 and a portion of which extends through and into the governor housing 28. Housing 22 is a separate casting which can easily be electrically isolated from the rest of the fuel pump, the engine and in particular from the governor housing 28 to which it mounts. Electrical isolation is achieved by the use of a nonconductive gasket 23, insulating sleeves 24 and insulating washers 25 on the four retaining bolts 26. The boost line 29 from the intake manifold 30 of diesel engine 31 is also nonconductive. As a consequence of this electrical isolation, there is electrical continuity between the housing 22 and the remainder of the engine (governor housing) only during the time when the rack finger 32 is in contact with the air-fuel cam 21. There is contact between the rack finger 32 and the air-fuel cam 21 only during air limited operation. In fact, contact between the rack finger 32 and the air-fuel cam 21 defines air limited operation.

As used herein, a "rack finger" is a device that is connected to the fueling rack which limits fueling rack travel by contacting either a full load cam or the air-fuel cam 21. The rack finger 32 moves in a vertical direction in response to engine speed and in a horizontal direction in response to fuel control lever position. In this way speed dependent fueling is achieved. The "full load cam" provides a fixed stop within the fuel pump (governor housing) which limits fueling rack travel. It has a contour which when taken together with the speed-dependent vertical movement of the rack finger, provides a speed-dependent, maximum fueling rack position.

Contact between the rack finger 32 and the air-fuel cain 21 (air limited operation) creates an "on" electrical signal which, according to the control system 20 of FIG. 1, activates solenoid valve 36 which in turn controls EGR valve 37. Engine exhaust from exhaust manifold 38 of engine 31 is routed to EGR valve 37 via flow line 39 and from there to the intake manifold 30 via flow line 40. When the solenoid valve 36 is activated (i.e., energized) the EGR valve 37 closes the flow of exhaust gas to the intake manifold 30.

It is to be understood that the air-fuel cam 21 is actually designed as part of a governor of an in-line fuel pump. A typical governor 41 for the present invention would be the style of governor currently used with the in-line fuel pumps which are used on the B Series and C Series diesel engines manufactured by Cummins Engine Company, Inc. of Columbus, Ind. This type of governor 41 is diagrammatically represented in FIGS. 2 through 4 and includes two fuel limiting cam stops 45 and 46 which are also schematically depicted in FIGS. 5 through 9. These two cam stops are positioned adjacent to each other within housing 28.

Figure 2:
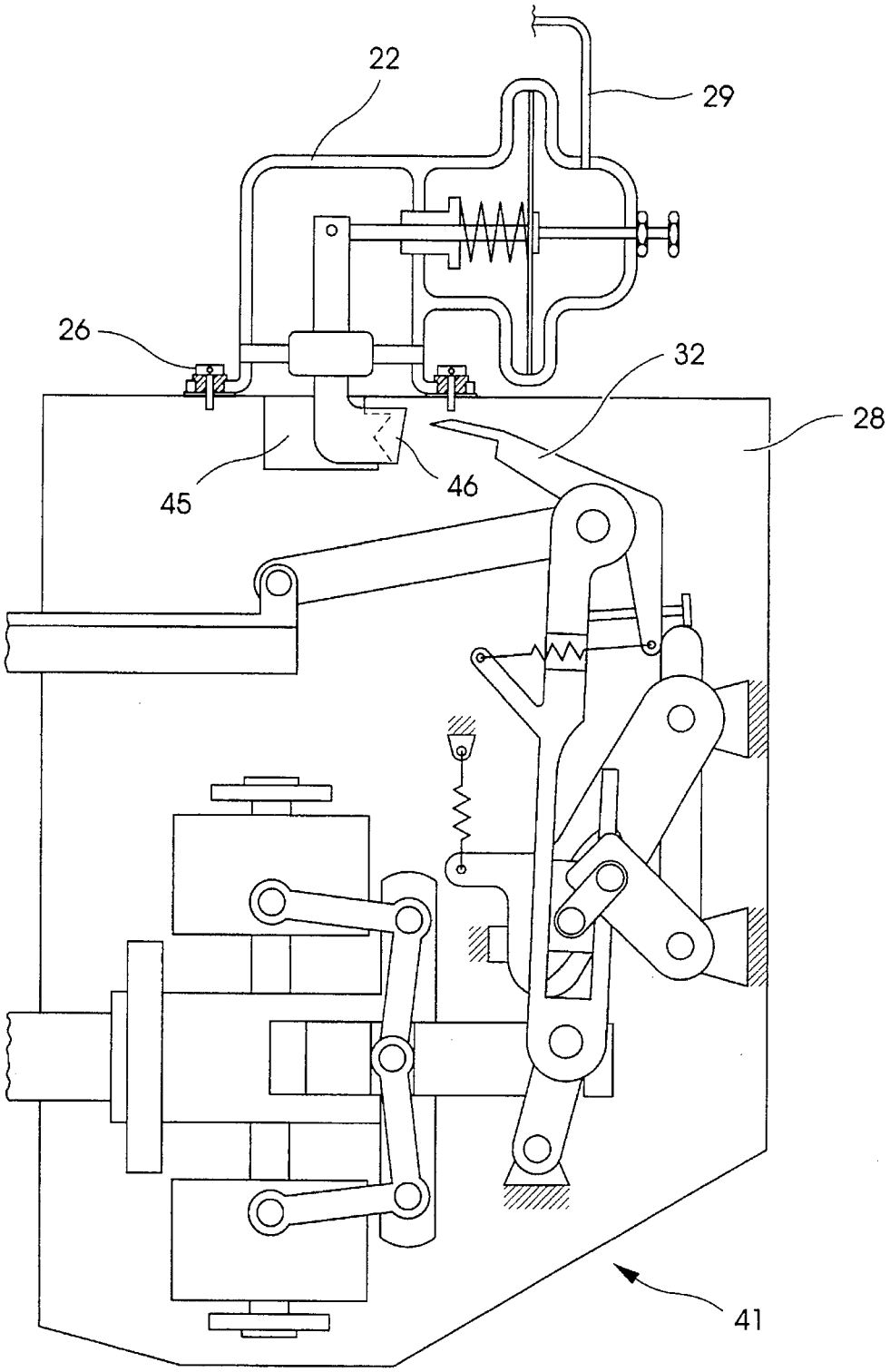
FIG. 2 is a diagrammatic side elevational view of a fuel pump governor which includes two fuel limiting stops and is suitable for use as part of the present invention.
Figure 3:
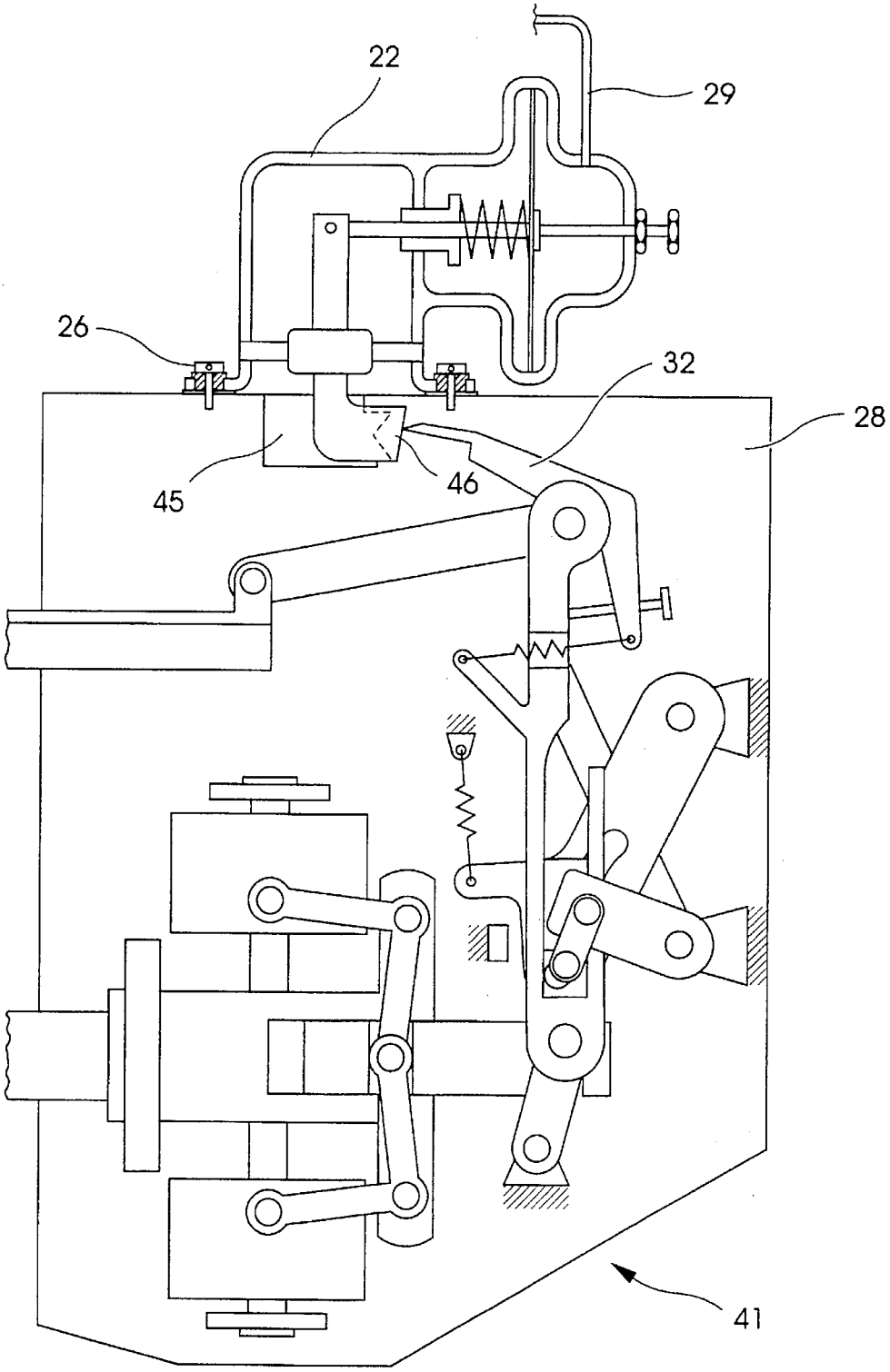
FIG. 3 is a diagrammatic side elevational view of the FIG. 2 fuel pump governor with the moveable rack finger now in contact with a first stop according to the present invention.
Figure 4:
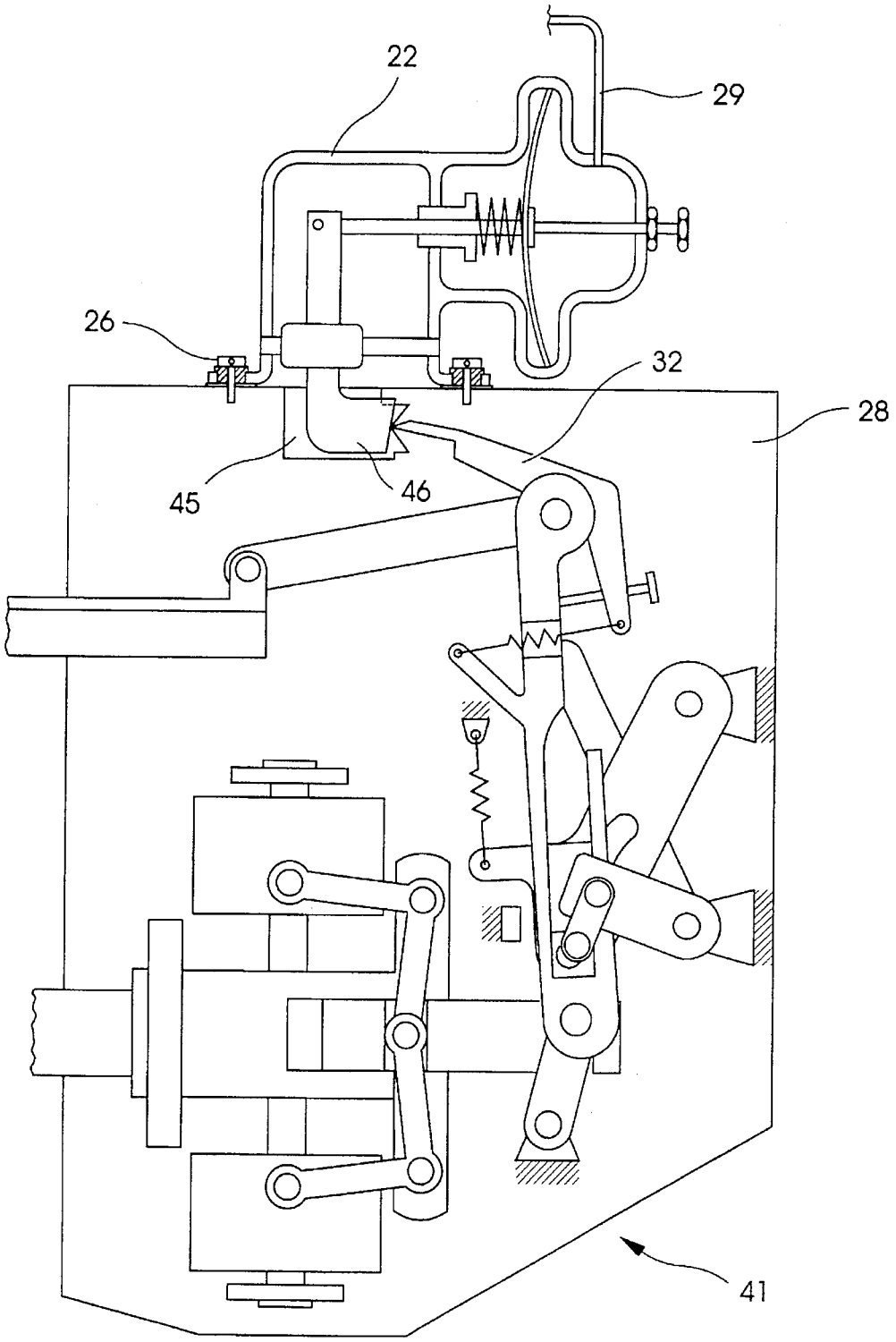
FIG. 4 is a diagrammatic side elevational view of the FIG. 2 fuel pump governor with the rack finger moved into contact with a second stop according to the present invention.
Figure 5:
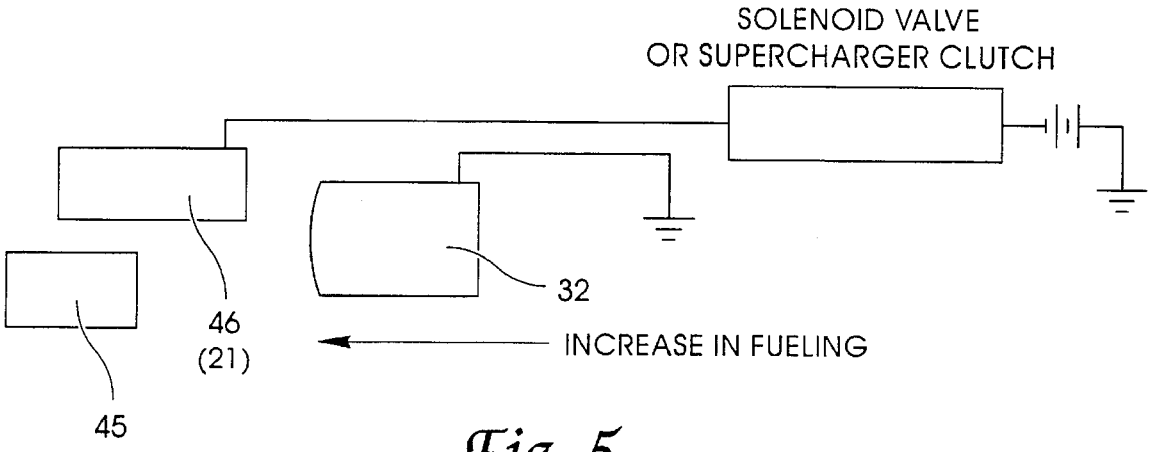
FIG. 5 is a schematic illustration representing the positioning of the rack finger relative to the first and second stops as would correspond to the FIG. 2 illustration.

One fuel limiting stop 45 (see FIGS. 2 and 5) is a fixed stop which limits the travel of the rack finger 32, and thus limits fueling, to a predetermined level. This fixed stop 45 is referred to as the "full load cam". The only variable which determines fuel quantity for the full load cam 45 is engine speed. The other fuel limiting stop 46 which limits the travel of the rack finger 32 is referred to as the "air-fuel cam" and has two independent variables which determine the fuel limit. Fuel limiting stop 46 as depicted in FIGS. 2 and 5 is represented and diagrammatically illustrated in FIG. 1 by air-fuel cam 21. The two independent variables are speed and engine boost pressure, thus the need for the nonconductive boost line 29 which is in flow communication with the intake manifold 30. The fuel pump governor 41 with its two fuel limiting stops 45 and 46 and the moveable rack finger 32 are illustrated in three different operating states in FIGS. 2 through 4. Also note in FIG. 4 that the boost pressure via line 29 has pushed diaphragm 42 to the left and as well, in response, the air-fuel cam is moved to the left.

The FIG. 2 illustration depicts the position of the rack finger 32 prior to any contact with either of the fuel limiting stops. The side elevational view of FIG. 2 corresponds generally to the schematic diagram of FIG. 5. With regard to FIG. 3, this illustrates the position of the rack finger within the governor when contact is made with the air-fuel cam (stop) 46, a condition which defines air limited operation. The illustration of FIG. 3 corresponds generally to the schematic depiction of FIGS. 6, 7 and 8. Finally, the side elevational view of FIG. 4 illustrates the position of the rack finger when contact is made with the second stop 45 (full load cam) and FIG. 4 corresponds generally to the schematic arrangement of FIG. 9. Since the boost pressure has pushed the air-fuel cam to the left, it no longer is in contact with the rack finger 32. This point signifies the end of air limited operation and a steady state condition.

Figure 6:
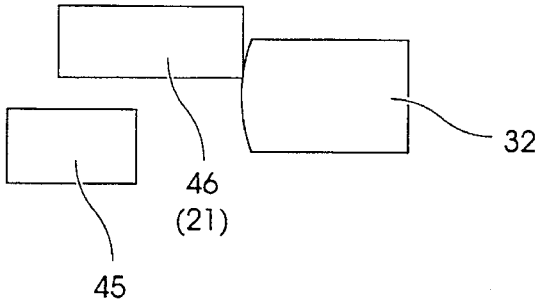
FIG. 6 is a schematic illustration of the contact between the rack finger and the first stop according to the present invention.
Figure 7:
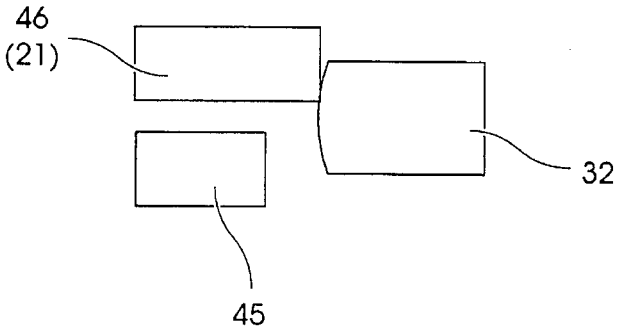
FIG. 7 is a schematic illustration of the contact between the rack finger and the first stop at approximately one second after the position of FIG. 6.
Figure 8:
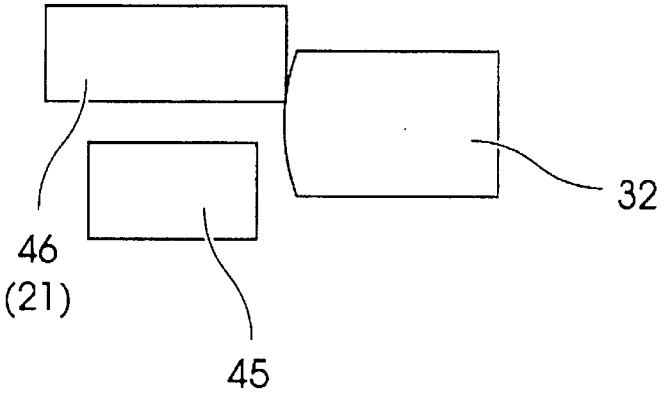
FIG. 8 is a schematic illustration of the contact between the rack finger and the first stop at approximately two seconds after the position of FIG. 6.
Figure 9:
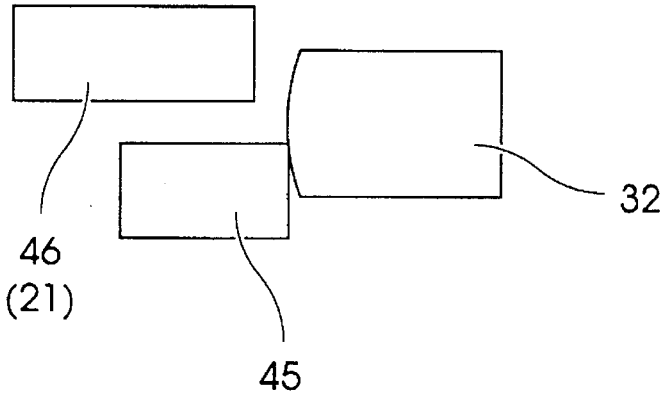
FIG. 9 is a schematic illustration of the rack finger in contact with the second stop according to the present invention.

Referring to FIGS. 5 through 9 the relative positions of the air-fuel cam 46 (21), full load cam 45 and rack finger 32 under various engine operating conditions are schematically illustrated. FIG. 5 corresponds to a throttle limited condition at 1600 rpm motoring. FIG. 6 represents an air limited condition at 1600 rpm—snap throttle at zero seconds. FIG. 7 is the same as FIG. 6 except at one second later. FIG. 8 is the same as FIGS. 6 except at two seconds later. Finally, FIG. 9 depicts a full load limited condition at 1600 rpm—full load, steady state. In the schematic representations of FIGS. 6, 7 and 8, the rack finger is in contact with the air-fuel cam 46 (21) and thus air limited operation is defined. The EGR is shut off according to the FIG. 1 control system 20 and remains off until the operating condition of FIG. 9 is reached. In FIG. 9 the rack finger 32 no longer contacts the air-fuel cam 46 (21) and the electrical signal created by such contact changes state (ON to OFF) and deactivates (i.e., deenergizes) the solenoid valve 36 enabling EGR flow to the intake manifold 30 via EGR valve 37.

As should be understood, backing off of the throttle also breaks contact between the rack finger 32 and the air-fuel cam 46 (21). As described, breaking contact deenergizes the solenoid valve 36 enabling EGR flow to the intake manifold 30 via EGR valve 37.

Figure 10:
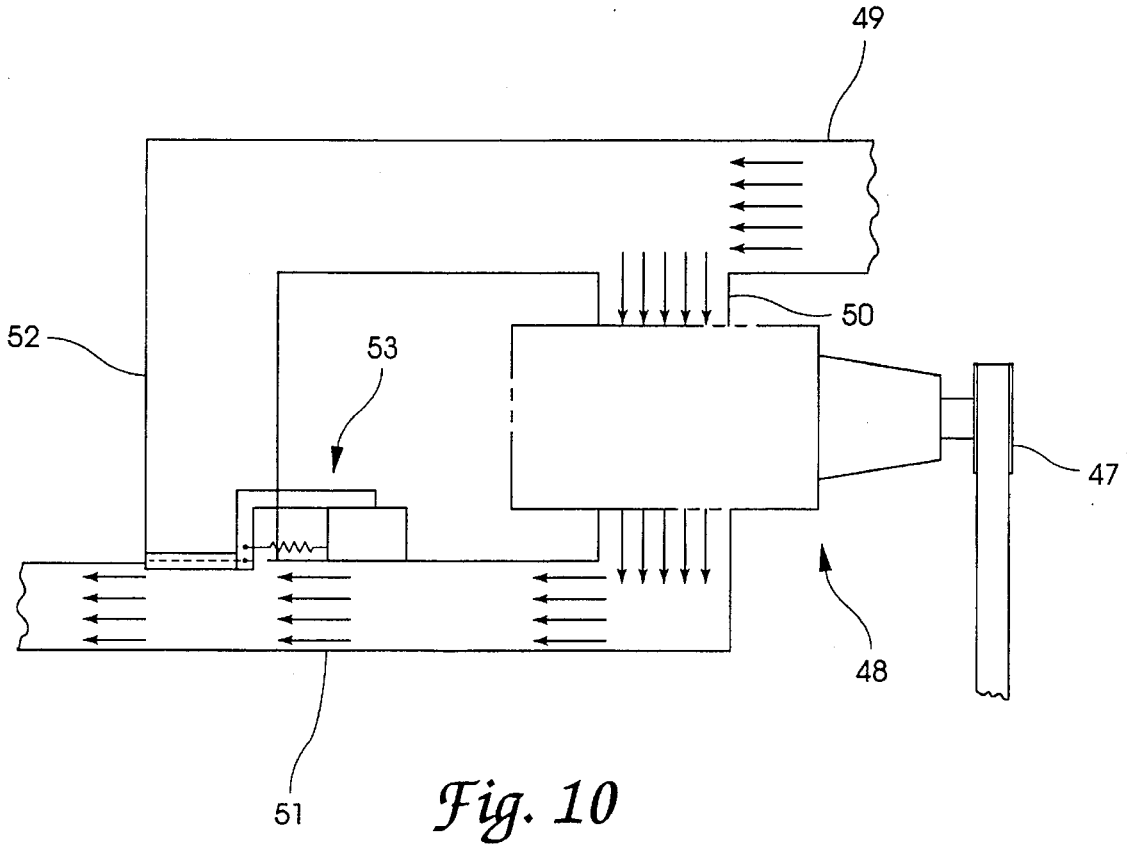
FIGS. 10 and 10A are schematic diagrams of a hybrid boosting system incorporating both a supercharger and turbocharger and including a control clutch.
Figure 10A:
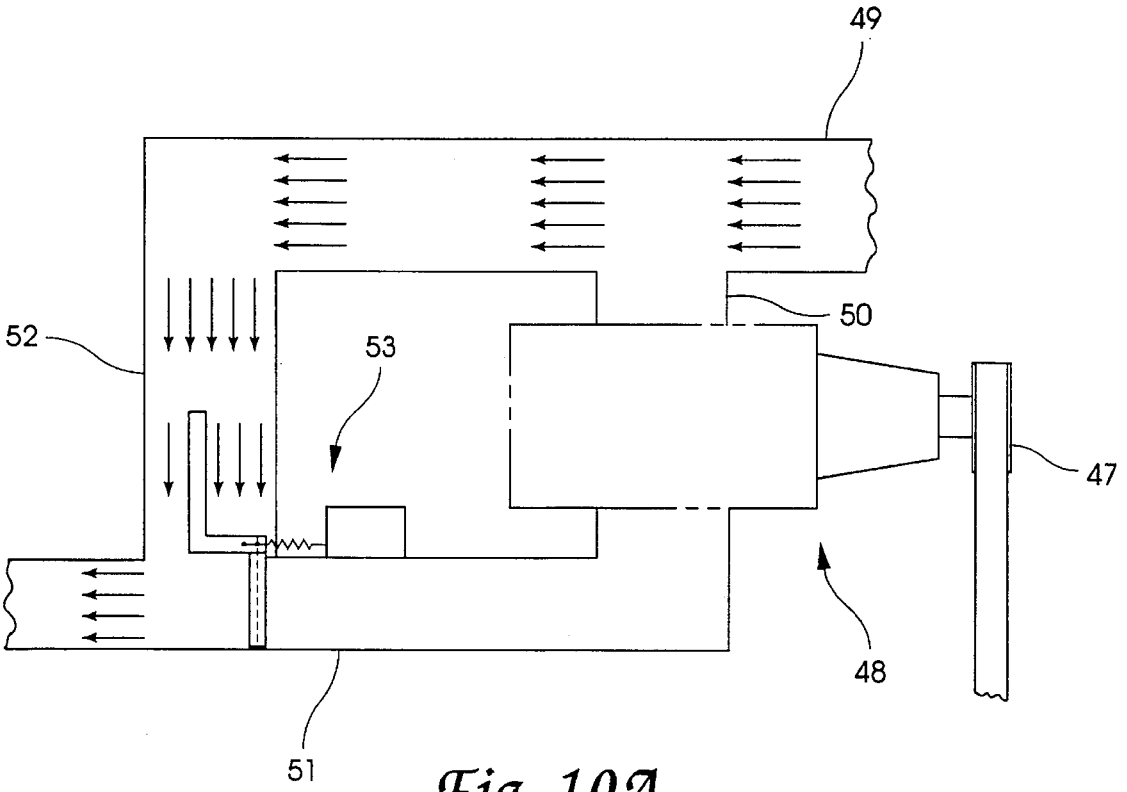

When it is desired to use the contact between the rack finger 32 and the air-fuel cam 46 (21) as a means to control a mechanically driven supercharger in a hybrid boosting system, the ON/OFF signal is used to control a clutch 47 on the supercharger 48 (see FIGS. 10 and 10A). In FIG. 10 the clutch 47 is energized and the supercharger 48 is being mechanically driven. Incoming air enters via flow conduits 49 and 50 and the exit flow passes to the compressor via flow conduit 51. Since the supercharger is being driven, all the air from the filter is routed into the supercharger. The air pressure in conduit 51 actually holds by-pass valve 53 closed and sealed. Valve 53 remains closed while the supercharger is being driven and it is important that there be no leakage across valve 53 in this condition.

Since FIG. 10 is only a schematic representation, it is important to understand that valve 53 completely closes off duct 52 from duct 51. This complete closing off is important so that the supercharger can build up pressure in duct 51.

In the FIG. 10A arrangement the control clutch 47 is disengaged and the supercharger 48 is therefore not driven. The practical effect to the flow of air from the filter is to see conduit 50 as a blocked passageway or at least a path of greater resistance while the path of least resistance is via conduit 52. The force of the air flow overcomes the spring-bias force on valve 53 which is forced open. The air flow from the filter bypasses the supercharger and is routed directly to the compressor via conduits 52 and 51. FIGS. 10 and 10A represent a hybrid system including both a supercharger and a turbocharger. The pivoting open of valve 53 is governed by the air pressure in conduit 52 relative to the spring constant. As a result of this it is possible that conduit 51 will not be completely closed off as is illustrated in FIG. 10A. It is not the function of valve 53 to pivot open and concurrently close off conduit 51. Since there is no flow through conduit 51, there is nothing to close off.

In the present invention it is envisioned that this rack finger/air-fuel cam control will be used as part of a hybrid boosting system. As described, the same signal which controlled the state of the solenoid valve 36 can be used to engage or disengage the mechanical drive to the supercharger. The end result is to be able to provide extra boost above that provided by the turbocharger, only when it is needed. By engaging the supercharger only when it is needed, the fuel consumption penalty which the supercharger causes, is minimized.

Figure 11:
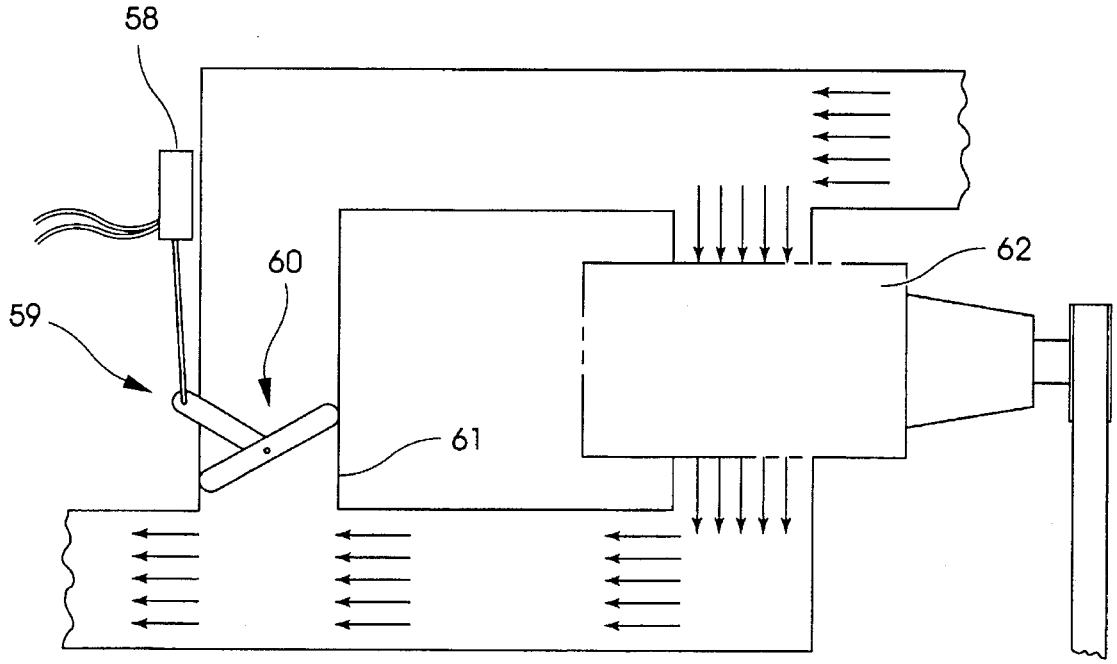
FIGS. 11 and 11A are schematic diagrams of a hybrid boosting system incorporating both a supercharger and turbocharger and including a control valve.
Figure 11A:
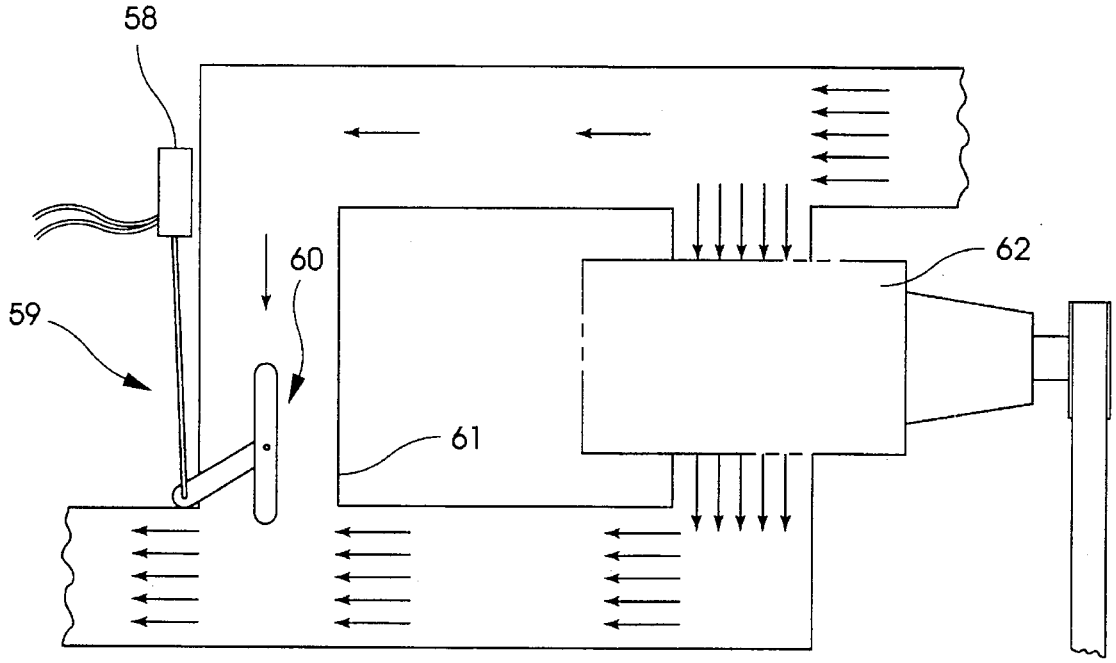

The electrical ON/OFF signal which is able to be created based on whether there is contact between the rack finger 32 and the air-fuel cam 46 (21) can be used to control the operational state of any number of electrical components or system functions. For example, with reference to FIGS. 11 and 11A, an alternative hybrid (supercharger and turbocharger) system is illustrated wherein an electrically-controlled actuator 58 is connected via linkage 59 to by-pass valve 60 which is positioned across conduit 61. The so termed "ON/OFF" (two state) electrical signal provided by the rack finger 32 and the air-fuel cam 46 (21) is used to control the actuator. When there is contact between the rack finger and the air-fuel cam, valve 60 is closed. When there is no contact, valve 60 is open. In the one state when the by-pass valve is closed, the air flow from the filter is routed through the supercharger 62. In the other state when the by-pass valve is open, the flow is through conduit 61. In this particular arrangement some portion of the flow may be permitted through the supercharger.

As a further aspect or enhancement to the present invention and as an additional measure to anticipate acceleration modes (particularly important as they relate to EGR control during the Federal Transient Emission cycle), a switch may be added to sense the throttle leaving its zero position. If a switch changes state as the throttle leaves its zero position, this signal can be incorporated into the electric controls to shut off EGR for a period of time in anticipation of air limited operation. If no air limited operation is encountered (as determined by the LDA switch) the EGR valve will reopen at the end of a time period. However, if air limited operation is sensed by the LDA switch, the EGR valve will remain closed for the duration of the air limited operation.

Finally, the switch used as an anticipator described above could be used as the only means for control if the delay from leaving a zero throttle position to reopening the EGR valve were set properly. If the delay period were set to include the typical time for intake manifold pressure to rise to a point of non air limited operation, the EGR valve could be reopened following this period and no significant particulate penalty would be encountered.

Figure 12:
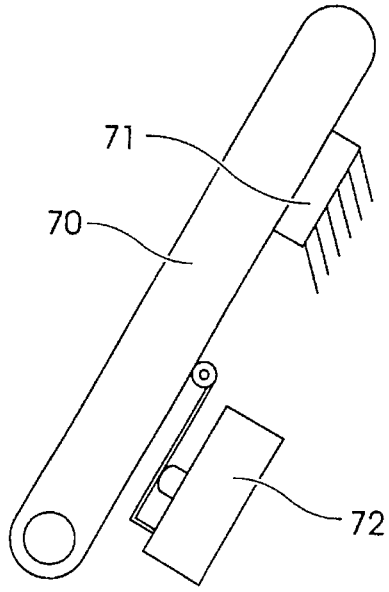
FIGS. 12 and 12A are schematic illustrations of an anticipator switch arrangement which may be used in combination with the present invention.
Figure 12A:
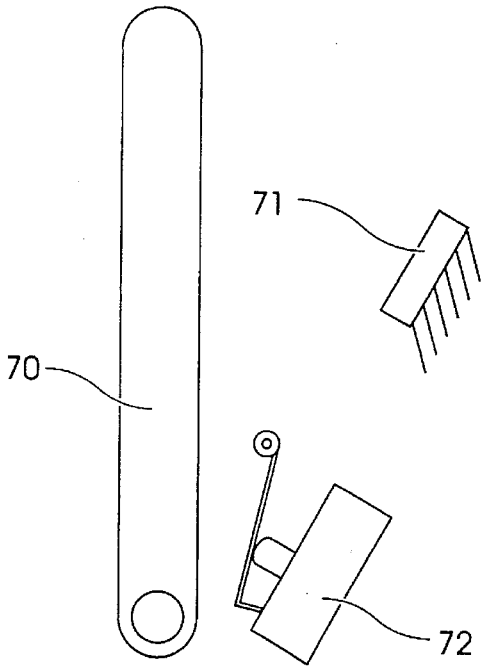

Referring to FIGS. 12 and 12A the mechanical arrangement involving the above theory is illustrated. In FIG. 12 the fueling control lever 70 is in contact with the idle stop 71 and the anticipator switch 72 is engaged (closed contact). The engine is at idle when the switch is in its first state. In FIG. 12A, as the fueling control lever 70 has moved away from the idle stop 71 and the anticipator switch 72 is open and is then in its second state.

While time invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A control system for a vehicle engine arranged to create an electrical signal for controlling engine-related functions, said control system comprising:

a fuel pump governor disposed within a governor housing;

an air-fuel cam housing mounted to said governor housing and receiving therein an air-fuel cam stop, a portion of said air-fuel cam stop extending beyond said governor housing;

electrical isolation means for electrically isolating said air-fuel cam housing from said governor housing;

an electrically grounded rack finger which is moveable into contact with said air-fuel cam stop via a connecting linkage in response to engine speed, wherein the contact of said air-fuel cam stop by said rack finger creates an electrical signal, said electrical signal being suitable to control the operational state of an engine-related function; and a full load cam stop disposed within said governor housing, wherein the portion of said air-fuel cam stop that extends beyond said governor housing is positioned adjacent to said full load cam stop.

2. The control system of claim 1 which further includes a solenoid valve which is electrically connected to said air-fuel cam housing and operable to change states in response to said electrical signal.

3. A control system for creating an electrical signal for energizing a remote function, said control system comprising:

a linkage arrangement disposed within a linkage housing;

a contact cam disposed within said linkage housing and being electrically isolated therefrom;

a grounded linkage finger which is moveable into contact with said contact cam in response to an external input, said external input being the speed of an engine, wherein contact of said contact cam by said linkage finger creates said electrical signal which is suitable to energize said remote function; and a stop cam disposed within said linkage housing and arranged in order to stop the advance of said linkage finger once a predetermined fueling level is reached at a given engine speed.

4. A control system for creating an electrical signal for energizing a remote function, said control system comprising:

a linkage arrangement disposed within a linkage housing;

a contact cam disposed within said linkage housing and being electrically isolated therefrom;

a grounded linkage finger which is moveable into contact with said contact cam in response to an external input wherein contact of said contact cam by said linkage finger creates said electrical signal which is suitable to energize said remote function; and wherein said remote function is the operation of a control clutch which is connected to a supercharger.

5. A control system for creating an electrical signal for energizing a remote function, said control system comprising:

a linkage arrangement disposed within a linkage housing;

a contact cam disposed within said linkage housing and being electrically isolated therefrom;

a grounded linkage finger which is moveable into contact with said contact cam in response to an external input wherein contact of said contact cam by said linkage finger creates said electrical signal which is suitable to energize said remote function; and wherein said remote function is the operation of a by-pass valve which is positioned within a supercharger flow loop.

6. A control system for creating an electrical signal for energizing a remote function, said control system comprising:

a linkage arrangement disposed within a linkage housing;

a contact cam disposed within said linkage housing and being electrically isolated therefrom;

a grounded linkage finger which is moveable into contact with said contact cam in response to an external input, wherein contact of said contact cam by said linkage finger creates said electrical signal which is suitable to energize said remote function; and a stop cam disposed within said linkage housing and arranged in order to stop the advance of said linkage finger once a predetermined fueling level is reached at a given engine speed.

7. A control system for creating an electrical signal for energizing a remote function, said control system comprising:

a linkage arrangement disposed within a linkage housing;

a contact cam disposed within said linkage housing and being electrically isolated therefrom; and a grounded linkage finger which is moveable into contact with said contact cam in response to an external input wherein contact of said contact cam by said linkage finger creates said electrical signal which is suitable to energize said remote function; and wherein said remote function is the operation of a solenoid valve which is connected to an EGR valve.

8. A control system for a vehicle engine arranged to create an electrical signal for controlling engine-related functions, said control system comprising:

a fuel pump governor disposed within a governor housing;

an air-fuel cam housing positioned adjacent to said governor housing and receiving therein an air-fuel cam stop, a portion of said air-fuel cam stop extending beyond said governor housing;

electrical isolation means for electrically isolating said air-fuel cam housing from said governor housing; and an electrically grounded rack finger which is moveable into contact with said air-fuel cam stop via a connecting linkage in response to engine speed, wherein the contact of said air-fuel cam stop by said rack finger creates an electrical signal, said electrical signal being suitable to control the operational state of an engine-related function.

9. The control system of claim 8 which further includes a full load cam stop disposed within said governor housing.

10. The control system of claim 9 wherein the portion of said air-fuel cam stop that extends beyond said governor housing is positioned adjacent to said full load cam stop.

11. The control system of claim 10 wherein said electrical isolation means includes a nonconductive gasket disposed between said air-fuel cam housing and said governor housing.

12. The control system of claim 8 which further includes a solenoid valve which is electrically connected to said air-fuel cam housing and operable to change states in response to said first electrical signal.

13. The control system of claim 12 which further includes an EGR valve electrically connected to said solenoid valve.

14. The control system of claim 13 which further includes a full load cam stop disposed within said governor housing.

* * * * *

UNITED STATES PATENT AND TRADEMARK OFFICE

CERTIFICATE OF CORRECTION

PATENT NO. : 5,572,972

DATED : November 12, 1996

INVENTOR(S) : Todd A. Sheridan, et al.

It is certified that error appears in the above-indentified patent and that said Letters Patent is hereby corrected as shown below:

On the title page:

Item: [57] (Abstract), in the third line from the bottom, replace "cain" with --cam--.

In Col. 2, line 16, replace "cain" with --cam--.

In Col. 3, line 55, replace "cain" with --cam--.

In Col. 6, line 28, replace "time" with --the--.

Signed and Sealed this

Twenty-fourth Day of June, 1997

Bruce Lehman

*Attest:*

BRUCE LEHMAN

*Attesting Officer*

*Commissioner of Patents and Trademarks*